United States Patent [19]

Metcalfe et al.

[11] 4,049,446

[45] Sept. 20, 1977

[54] ENERGIZED LIQUID DEVELOPERS FOR DEVELOPING ELECTROSTATIC IMAGES

[76] Inventors: Kenneth A. Metcalfe, 1 Corona Avenue, Lockleys, South Australia 5032; Clive Westgarth Wilson, 23 Bowden Grove, Oaklands Park, South Australia 5045; Denton Field, 23 Nyonga Avenue, Croydon Park, South Australia 5008, all of Australia

[21] Appl. No.: 656,822

[22] Filed: Feb. 9, 1976

Related U.S. Application Data

[62] Division of Ser. No. 401,966, Sept. 28, 1973, abandoned.

[30] Foreign Application Priority Data

Oct. 4, 1972 Australia ..... 691/72

[51] Int. Cl.[2] ..... G03G 13/10

[52] U.S. Cl. ..... 96/1 LY; 427/17; 252/62.1 L

[58] Field of Search ..... 96/1 LY, 1.5, 1.8; 252/62.1; 427/15, 17

[56] References Cited

U.S. PATENT DOCUMENTS

| | | | |
|---|---|---|---|
| 3,078,231 | 2/1963 | Metcalfe et al. | 252/62.1 |
| 3,406,062 | 10/1968 | Michalchik | 96/1 LY |
| 3,766,072 | 10/1973 | Metcalfe et al. | 96/1 LY X |
| 3,793,015 | 2/1974 | Van Engeland et al. | 252/62.1 X |
| 3,811,914 | 5/1974 | Saito et al. | 96/1 LY X |

FOREIGN PATENT DOCUMENTS

| | | | |
|---|---|---|---|
| 1,070,718 | 6/1967 | United Kingdom | 96/1.5 |
| 1,214,150 | 12/1970 | United Kingdom | 96/1.5 |

*Primary Examiner*—Roland E. Martin, Jr.

[57] ABSTRACT

A method of developing electrostatic images in which a liquid developer is maintained in quiescent condition in contact with the base material carrying the electrostatic image and wherein the developer contains in separate coexistence within an insulating carrier liquid toner particles of relatively low dielectric constant and movement-inducing particles having a high dielectric constant. The presence of both sets of particles results in agitation in the liquid due to particle movement in a field by charge exchange between the high dielectric particles and the other particles to produce random agitation of the particles in the liquid and thereby high mobility of the toner particles during developing.

2 Claims, No Drawings

ENERGIZED LIQUID DEVELOPERS FOR DEVELOPING ELECTROSTATIC IMAGES

CROSS RELATED APPLICATION:

This application is a division of copending application Ser. No. 401,966 filed Sept. 28, 1973, now abandoned, and claiming the priority of the application filed in Australia on Oct. 4, 1972.

This invention relates to energised liquid developers for developing electrostatic images.

BACKGROUND OF THE INVENTION

Liquid developers usually consist of developer particles suspended in an insulating liquid having a resistivity in excews of $10^{10}$ ohm. c.m. and a dielectric constant less than 3, the developer particles being coated with an insulating medium such as a resin whereby to control the polarity of the particles in the insulating liquid and also to provide the means whereby the rate of exchange of charges between the particles and a surface containing a latent electrostatic image is slowed down, and such resin or other insulating medium can also be such that on the position an evaporation of a carrier liquid this forms a fixing medium for the particles.

Such a developer is already well-known and various applications by the applicant have proceeded to the grant of patents and have been brought into commercial use.

One of the problems associated with developers of this type is that the particles tend to settle out, this settling increasing with a coarseness of the particles and thus it has been customary to prepare the developer in the form of a relatively thick paste and to break down the developer by adding the carrier liquid just prior to use on the developer, the paste being thoroughly mixed into the carrier liquid so that at the time of development the particles of toner or developer medium are uniformly dispersed throughout the carrier liquid.

It has been shown in the past that improved development results where there is agitation of the developer just prior to it being applied and also that improved images result where the developer is agitated at the time of application to the surface containing the latent electrostatic image, and to achieve this it has been proposed to apply the developer liquid to the surface with a washing action so that the surface is swept by the developer for a required time to ensure that sufficient particles are brought into the image field to deposit to give an image of a required density.

SUMMARY OF THE INVENTION

We have now found that a developer such as that described can be improved by including in the developer formulation, as well as toner particles, conductive particles which move rapidly in a field and thus act to keep the developer particles in relatively rapid motion when both the developer particles and the conductive particles co-exist in the carrier liquid. The basis of the invention is that conductive particles, such as metal particles, can readily exchange charges with a surface containing a latent image or with other particles and can thus alternate rapidly under such conditions.

Thus the image which is to be developed may have a negative characteristic and if the conductive particles have an inherent positive characteristic in the carrier liquid, which can be given to them by a control coating on the surface, they will be drawn down to the negative field area, but because they are able to exchange charges, they will, on approaching the surface, interchange charges with the surface and as they become sufficiently negative will be repelled from the surface, but as they leave the influence of the negative field they are again able to exchange charges with other conductive particles or other areas and will again become relatively positive in relation to the image charge so that they will be again drawn to it but immediately repelled on an exchange of the charges.

In this way the developer contains toner particles which are inherently insulators, such as coloured dyed particles, and which are not able to readily exchange charges and thus go down on the image and remain there sufficiently long to provide the necessary developed image as has been referred to in numerous patents already on record, but by having a developer mixture which also contains particles of high conductivity even if partial control is exerted by a surface layer of resin, the developer is now activated or energised when in the presence of a field because the conductive particles tend to move on to and then away from the surface containing the field and during this action affect a stirring or energising of the developer to ensure that there is a rapid movement in all of the particles through collisions and the like and development takes place as it were by means of a developer which is in an agitated state so soon as it is applied to a surface having a latent electrostatic image. Metal particles are envisaged having a high dielectric constant so that even if coated by an insulator the conductive characteristic will predominate.

In this connection it is important to remember that short and long range interactions with a centre occur in all cases, but short range interactions dominate for tightly bound electrons in low dielectric constant materials, but long range interactions dominate in high dielectric constant materials, thus making it possible to use even coated high dielectric constant materials such as the metals of the examples.

In this connection it should be remembered also that when a surface contains a latent electrostatic image with the image being formed of one polarity, those areas which are not image areas are relatively of opposite polarity and therefore because this relativity, the conductive particles are assured rapid motion.

It will be appreciated that if the photosensitive surface is itself highly insulating, charge exchanges with the surface cannot take place, but as an image field exists which extends from the surface, the conductive particles are influenced by the field itself.

Alternatively the surface is made less insulating by including in the photosensitive layer some conductive particles or solvents which affect conductivity, which can readily be influenced by the image field as they exist in the insulating layer which supports the field and these conductive inserts or inclusions then form ready charge exchange means with the conductive particles in the developer.

For this reason coatings are suggested which when used in conjunction with the developer, enhance the effect thereby.

The following examples show how developers having this energised effect can be formulated.

EXAMPLES OF COATINGS

Electrophotographic coatings may be produced as follows:

| Coating A | |
|---|---|
| Isojordosol 4501/60 short oil alkyd resin (Jordan Chemicals) | 430 grams |
| Zinc oxide (colloidal grade) (Durham) | 158 grams |
| Aluminium bronze | 1 gram |
| Rose Bengal (sensitiser dye) | 0.2 grams |
| Toluol | 1200 milliliters |
| These materials were ball milled together to form a coating composition. | |
| Cobalt and zinc naphthenate driers were added (0.5% and 0.5% by wt. of solid resin). | |

This coating can be applied to either film, metal backing or paper.

| Coating B | | |
|---|---|---|
| Styrene-butadiene copolymer Esso polymer 200 (Buton 200) | | 150 grams |
| Zinc oxide | | 500 grams |
| Lead naphthenate | 6% solution in mineral spirits | 1.0 gram |
| Cobalt naphthenate | 6% solution in mineral spirits | 0.1 gram |
| Nickel powder | | 1 gram |
| Zirconium octoate | 6% solution in mineral spirits | 1 gram |
| Cerium octoate | 6% solution in mineral spirits | 0.05 grams |

The naphthenate and octoates increase the conductivity.

| | |
|---|---|
| Solvent Alsol 95/130 | 900 milliliters |
| Toluol | 65 milliliters |
| Hexyl acetate | 10 milliliters |
| Ethyl acetate | 10 milliliters |
| Butanol | 10 milliliters |
| Pentoxone | 5 milliliters |
| Disulphine Blue | 1% by wt. in methyl alcohol 2 milliliters |
| Acridine Orange | 1% by wt. in methyl alcohol 2 milliliters |
| Erythrosin B | 1% by wt. in methyl alcohol 2 milliliters |
| Sodium fluorescein | 5 milliliters |

The latter materials form sensitisers in different wave lengths.

These materials are ball milled together and dip coated on paper, metal, wood, or film base to form a photoconductive layer.

| Coating C | | |
|---|---|---|
| Jordosol 2232/50 short oil alkyd resin (Jordon Chemicals) | | 400 grams |
| Zinc oxide (colloidal grade) (Durham) | | 1200 grams |
| Bromocresol Green | 0.5% by wt. in methyl alcohol | 10 milliliters |
| Bromophenol Blue | 0.5% by wt. in methyl alcohol | 10 milliliters |
| Sodium Fluorescein | 1% by wt. in methyl alcohol | 10 milliliters |
| Erythrosin B | 1% by wt. in methyl alcohol | 10 milliliters |
| Cobalt Naphthenate | 6% solution | 0.1 grams |
| Zinc Naphthenate | 3% solution | 1.0 grams |
| Solvent (Esso) Alsol 95/130 | | 2,000 milliliters |

These materials are ball milled together to form an electrophotographic coating composition having a relatively high conductivity and increased sensitivity due to greater colour absorption.

| Coating D | |
|---|---|
| Mowital B 30 H (Polyvinyl Butyral resin) (Hoechst) | 100 grams |
| Zinc Oxide - special z grade (Durham) | 1000 grams |

The Mowital was taken up in 800 milliliters of methyl ketone and 200 milliliters of methyl alcohol and ball milled with the zinc oxide which was previously dyed with the following:

| | |
|---|---|
| Sodium Fluorescein | 1% solution in methanol 10 milliliters |
| Erythrosin B | 1% solution in methanol 5 milliliters |
| Rose Bengal | 1% solution in methanol 2 milliliters |
| Bromocresol Green | 0.5% solution in methanol 5 milliliters |
| Bromophenol Blue | 0.5% solution in methanol 5 milliliters |

This coating composition was let down with 500 milliliters of methyl ethyl ketone solvent and 500 milliliters of perchloroethylene to form the final coating composition.

EXAMPLES OF DEVELOPERS

| Developer 1 Negative Black Developer | |
|---|---|
| Kohinoor Carbon Black | 100 grams |
| Sunflower seed oil (Meggitts) | 300 grams |
| B.P.V. oil (Viscostatic) (British Petroleum) | 500 grams |
| Alkyd resin (1352/60) Super Beckosol (Reichold Chemicals) | 200 grams |

The above ingredients are milled together and then suspended together with 1 gram aluminum bronze powder in 100 mls. Esso 100 and 1,000 mls Isopar E.

This developer is applied to the latent image on a relatively conductive photoconductive coating and acts as an energised developer with relatively rapid charge exchange effects and consequent high mobility in an image field.

| Developer 2 Copolymeric Blue Developer | |
|---|---|
| Hostaperm Blue B3G (Hoechst) | 100 grams |
| Styrene-butadiene copolymer e.g. "Solprene 1205" | 200 grams (Phillips Imperial Chemicals) |
| Vinyl toluene-acrylate copolymer e.g. "Pliolite VTAC" Australian Synthetic Rubber Co. | 100 grams |
| Zinc powder, 1 micron mean diameter | 1 gram |

The copolymeric resins were taken up in Solvesso 100 and subsequently milled with the blue pigment.

| Developer 3 | |
|---|---|
| (Copolymeric suspension in Isopar E (Esso), and isoparaffinic hydrocarbon solvent). | |
| Isopar E | 200 mls. |
| "Solprene 1205" (solution of 1 gram of solid in 2 mls.) | 5 grams |
| "Pliolite VTAC" (solution of 1 gram of solid in 2 mls.) | 5 grams |
| | 0.1 parts by wt. |
| Aluminium powder | 1 gram |

The developer can be applied by a simple electrode or by a roller.

| | |
|---|---|
| Developer 4 | |
| Blue | |
| Graphtol Blue BLF. (Sandoz) | 54 grams |
| Solprene 1205 | 20 grams |
| VTAC | 10 grams |
| Nickel powder | 1 gram |
| Dispersed in: | |
| Esso 100 | 100 mls. |
| Isopar E | 1000 mls. |
| Developer 5 | |
| Hostaperm Blue B3G (Hoechst) | 54 grams |
| Solprene 1205 | 61 grams |
| VTAC | 32 grams |
| Copper powder | 0.5 grams |
| Dispersed in: | |
| Esso 100 | 100 mls. |
| Isopar E | 1000 mls. |
| Developer 6 | |
| Graphtol yellow 4813 - 0 (Sandoz) | 40 grams |
| Solprene 1205 | 20 grams |
| VTAC | 10 grams |
| Intermetallic compound powder | 0.5 grams |
| Dispersed in: | |
| Esso 100 | 100 mls. |
| Isopar E | 1000 mls. |
| Developer 7 | |
| Permanent yellow GG (Hoechst) | 40 grams |
| Solprene 1205 | 10 grams |
| VTAC | 7 grams |
| Tin powder | 0.5 grams |
| Dispersed in: | |
| Esso 100 | 100 mls. |
| Isopar E | 2000 mls. |
| Developer 8 | |
| Graphtol Red 1630 | 60 grams |
| Solprene 1205 | 10 grams |
| VTL Copolymer | 10 grams |
| Iron powder | 0.5 grams |
| Dispersed in: | |
| Esso 100 | 100 mls. |
| Isopar E | 2000 mls. |
| Developer 9 | |
| Isol Ruby Red | 50 grams |
| Brillfast Rose Red | 30 grams |
| Pale lowering Lithographic Varnish | 20 grams |
| Rhodene alkyd resin L42/70 | 200 grams |
| Nickel powder | 0.5 grams |
| Dispersed in: | |
| Esso 100 | 100 mls. |
| Isopar E | 2000 mls. |
| Developer 10 | |
| Isol Ruby Red | 50 grams |
| Brillfast Rose Red | 30 grams |
| Alkyd resin P470 | 105 grams |
| Beeswax | 12 grams |
| Toluene | 15 mls. |
| Chromium powder | 0.5 grams |
| Dispersed in: | |
| Esso | 100 mls. |
| Isopar E | 1000 mls. |
| Developer 11 | |
| Aluminium bronze metal powder | 100 grams |
| Alkyd Resin P470 | 20 grams |
| Toluene | 15 mls. |
| Dispersed in: | |
| Esso 100 | 50 mls. |
| Isopar G | 1000 mls. |

It is to be noted that in developer 11 the aluminum bronze metal powder additive can be replaced by silver, zinc, aluminum, iron, chromium, copper tin or other metal powder and also that the resin can be replaced by other alkyd resins, or by phenolformaldehyde, polymers, or shellac, polyethylene, polyisobutylene, polyisoprene, polyvinylacetate, polymethylmethacrylate, cellulose, ethyl cellulose, ethyl hydroxy ethyl cellulose, cellulose acetate, polyvinylchloride, polyvinyl chlorinated rubber, polyamides, polyesters or the like and further that this developer may be used as a dispensible additive in other developers.

CHEMICAL REFERENCES

ISOJORDOSOL 4501/6 short oil alkyd resin (Jordan Chemicals) oil length 50%, specific gravity 0.99–1.00, oil type safflower, Viscosity G.H, WX. Acid No. 5–10.

JORDOSOL 2232/50 a short oil alkyd resin (Jordan Chemicals) oil length 40%, specific gravity 1.020, oil type D.C.O. Viscosity G-H, Z-Z1, Acid No. 15–20.

MOWITAL B30H polyvinyl butyral resin, made by Hoechst, Germany; containing polyvinyl acetal 76–78 percent polyvinyl acetate 1 percent and polyvinyl alcohol 18–21 percent.

B.P.V. OIL synthetic automotive lubricating oil containing anti-oxidant "ZDP," dialkyl zinc dithiophosphate in solution, made by British Petroleum Ltd.

HOSTAPERM BLUE B3G copper phthalocyanine blue, pure beta-form, made by Hoechst, C.I. pigment Blue 15, Colour Index No. 74,160.

SOLPRENE 1205 is a block co-polymer of butadiene and styrene in the ratio of 75/25 manufactured by the Solution Polymerization process. Contains 97.5 Rubber Hydrocarbon. It is stabilized by addition of 1% of a non-staining anti-oxidant.

Max IBM Colour 3 (Phillips Imperial Chemicals Ltd.)

PLIOLITE VT RESIN is a styrene/butadiene type copolymer rubber made by Goodyear Corp., U.S.A. and prepared by the "G.R.S." method in which the butadiene polymerises in the main by a 1,4-addition. Pliolite VT is a vinyl toluene/butadiene random copolymer rubber soluble in mineral spirits.

GRAPHTOL YELLOW MONO AZO Dye Stuff Pigment, by SANDOZ LTD, Switzerland, C.I. Pigment 66, C.I. 1,800-1.

PERMANENT YELLOW 66 extra, a diazo yellow pigment without lake forming groups, C.I. pigment yellow 17, Colour Index No. 21105.

GRAPHTOL RED MONO AZO DYE BY SANDOZ LTD. Switzerland C.I. Pigment 1, C.I. 11,000–680.

ISOL RUBY RED BKS 7520 (KVK) a lithol ruby red C.I. Pigment Red 57, Agfa, Calcium lake.

RHODENE ALKYD RESIN L42/70 a pure drying long oil alkyd resin (Polymer Corp.) oil length 64%, oil type safflower, specific gravity 0.957, Viscosity (G-H) 4–7, Acid No. 6–10.

BECKOSOL ALKYD RESIN P470/70 a pure drying long oil alkyd resin (Hatrick) Oil length 65%, oil type Soya, specific gravity 0.955, Viscosity (G–H) Z1–Z2, Acid No. 3–7.

ISOPAR E a hydrocarbon solvent (Esso Chemicals) boiling range 117°–144° C, Aromatic content 0.05, flash point upward 73° F, Specific gravity 0.723.

ISOPAR G a hydrocarbon solvent (Esso Chemicals) boiling range 158°–177° C, aromatic content 0.20, flash point 103° F, specific gravity 0.750.

SOLVESSO 100 a hydrocarbon solvent (Esso Chemicals) boiling range 156°–171° C, aromatic content 98.9, flash point 110° F, specific gravity 0.874.

We claim:

1. A method of developing electrical field images which comprises applying a developer to a base material having a coating comprising a photosensitive medium and a resin having embedded therein particulate conductive particles or a medium which increases the conductivity in the proportion by weight of 100 to 500 grams of resin to 0.5 to 2 grams of conductive material to form a membrane capable of sustaining a latent electrostatic image, said developer being an energized liquid developer comprising in separate co-existence within an insulating liquid of (a) toner particles of relatively low dielectric constant arranged due to their electrical characteristic to deposit on selected image areas and (b) movement-inducing high dielectric constant metallic powder particles which have a rapid charge exchange with other particles and adjacent surfaces to cause the said high dielectric particles to oscillate between other particles and the said surfaces whereby by collisions of said particles and the toner particles to introduce random agitation of particles in the liquid and by the presence of the photoconductive particles in the photosensitive base, and the metallic particles in the carrier liquid of the developer, agitation is enhanced at the interface between the liquid and the photoconductor due to charge exchange between the fixed conductive particles in the photoconductor and the moving metal particles in the developer liquid, maintaining said body of developer itself quiescent except for the random particle movement, said toner particles being colored resin particles, said metal powders being selected from the group consisting of aluminum, bronze powder, zinc powder, aluminum powder, copper powder, intermetallic compound powder, tin powder, iron powder, and chromium powder.

2. The method of claim 1 in which said toner particles comprise a coloring medium in particulate form having a resin control coating on said particles formed by milling toner medium in the presence of a dissolved resin.

* * * * *